US009180935B2

(12) United States Patent
Rijken et al.

(10) Patent No.: US 9,180,935 B2
(45) Date of Patent: Nov. 10, 2015

(54) METHOD AND APPARATUS FOR HAWSER CONNECTION IN A TLP—TAD SYSTEM

(71) Applicant: Seahorse Equipment Corp, Houston, TX (US)

(72) Inventors: Oriol R. Rijken, Houston, TX (US); Robert M. Kipp, Fulshear, TX (US)

(73) Assignee: Seahorse Equipment Corp, Houston, TX (US)

( * ) Notice: Subject to any disclaimer, the term of this patent is extended or adjusted under 35 U.S.C. 154(b) by 313 days.

(21) Appl. No.: 13/779,173

(22) Filed: Feb. 27, 2013

(65) Prior Publication Data

US 2013/0220201 A1 Aug. 29, 2013

Related U.S. Application Data

(60) Provisional application No. 61/604,019, filed on Feb. 28, 2012.

(51) Int. Cl.

| | |
|---|---|
| ***B63B 21/20*** | (2006.01) |
| ***B63B 21/04*** | (2006.01) |
| ***B63B 21/50*** | (2006.01) |

(52) U.S. Cl.

CPC ..... *B63B 21/20* (2013.01); *B63B 21/04* (2013.01); *B63B 21/50* (2013.01)

(58) Field of Classification Search

CPC .. B63B 21/04; B63B 21/20; B63B 2021/203; B63B 21/50; B63B 2021/505; B63B 35/44; B63B 35/4413

USPC ..... 114/230.1, 230.2–230.26, 264, 265, 114/293; 441/3–5; 405/195.1, 223.1, 224

See application file for complete search history.

(56) References Cited

U.S. PATENT DOCUMENTS

| | | | | |
|---|---|---|---|---|
| 5,423,632 | A * | 6/1995 | Ekvall et al. | 405/223.1 |
| 6,575,111 | B2 | 6/2003 | Beato | |
| 6,619,223 | B2 | 9/2003 | Beato | |
| 7,383,784 | B2 * | 6/2008 | Eilertsen | 114/230.2 |
| 2007/0234944 | A1 * | 10/2007 | Kant | 114/230.17 |

* cited by examiner

*Primary Examiner* — Ajay Vasudeva
(74) *Attorney, Agent, or Firm* — Blank Rome LLP

(57) ABSTRACT

A hawser system between a tension leg platform (TLP) and another vessel employs two lines, oriented in a V-shape, to restrict the vertical motion of a hawser near the bow of the other vessel which may be a semi-submersible tender assisted drilling vessel (TAD). Drilling operations may be performed from the TLP while the semi-submersible provides the supporting services for the drilling operation, e.g. drilling fluid and drill pipe storage. The restricted vertical motion of the hawsers significantly reduces the possibility of the hawsers contacting each other. A hawser system according to the invention couples the semi-submersible TAD vessel to the TLP and may be implemented without passing the hawsers through sheaves.

11 Claims, 7 Drawing Sheets

10
12
12a
12b
12c
12d
14
16
20
22
22a
22b
22c
22d
24
26
28
30
30a
30b
30c
30d
40
50
50'
60
61
62
63
64
65
1C 230a
230d
240
240
250
250'
230b
230c
2C
2C 230b,
230c

250'
230
241
241
242
242
265
265
250
230

230a
241
241
250'
242
265
230b 230a
241
250
242
230b 332a
334a
334a
332a
350
350
3C
3C
332b
334b
334b
332b 332b,
334b 341a
341b
341a
342a
342b
342a 334a
332a
341a
350
350
342a
365
332b
334b 341
332a
350
342
332b 634a
634a
632a
632a
641a
641a
641b
641b
5C
5C
632b
634b
634b
632b 632b, 634b
632b, 634b 641b
642b
642a
641a

641a 634a
632a
650
632b
641b
642b
634b
642a
634b 634a
650
641b
642b
634b

METHOD AND APPARATUS FOR HAWSER CONNECTION IN A TLP—TAD SYSTEM

CROSS-REFERENCE TO RELATED APPLICATIONS

This application claims the benefit of U.S. Provisional Application No. 61/604,019, filed on Feb. 28, 2012.

STATEMENT REGARDING FEDERALLY SPONSORED RESEARCH OR DEVELOPMENT

Not Applicable

BACKGROUND OF THE INVENTION

1. Field of the Invention

This invention relates to offshore platforms used for drilling operations. More particularly, it relates to tension leg platforms used in conjunction with another vessel in tender-assisted drilling operations.

2. Description of the Related Art including information disclosed under 37 CFR 1.97 and 1.98.

Both tension leg platforms (TLP's) and semi-submersible floating vessels ("semis") can be used for offshore drilling and production operations.

It can be difficult and costly to provide a TLP with adequate space for all the drilling and completion equipment needed to drill and complete a well—e.g., drill pipe, drilling and completion risers, casings, other tubular goods and drilling and completion fluids. Tenders are often employed to provide the required space needed on a rig and/or platform during the initial drilling and completion phase of an offshore oilfield. However, a problem exists in that most tenders cannot be kept alongside a platform in a constant spaced-apart relationship during extreme weather so as to colliding with the platform. Specifically, tenders have not been able to remain in a connected capacity and avoid the risk of collision.

U.S. Pat. No. 6,619,223 to Beato and entitled "Tender with hawser lines" describes a hawser system for connecting a semisubmersible tender to a deep draft caisson vessel comprising: a first winch and a second winch disposed on the first end of the tender; a first hawser connected to the first winch and a second hawser connected to the second winch; a first sheave and a second sheave disposed on a second end of the tender opposite the first end of the tender, the first sheave for engaging the first hawser and the second sheave for engaging the second hawser; a first hawser fairlead disposed on a first side of the tender for receiving the first hawser and a second hawser fairlead disposed on the second side of the tender for receiving the second hawser and wherein the first hawser crosses the second hawser three times as each is reaved to each fairlead and wherein the first and second hawsers pass beneath the deck of the tender to the deep draft caisson vessel; at least one connector or joining the first and second hawsers at a position in the deep draft caisson vessel, after the hawsers pass each fairlead.

U.S. Pat. No. 6,575,111 also to Beato and entitled "Method for tendering" describes a method of using a semi-submersible tender with a deck, a shape that results in a combined environmental load less than 1000 kips in a 100-year extreme weather condition, a plurality of supports each with a rounded shape connected to the deck, a plurality of pontoons connecting the supports with each pontoon being capable of ballast transfer, wherein the tender is used for mooring in a tendering position relative to an offshore platform using hawsers with adequate elasticity to accommodate the wave frequency between the platform and the tender and adequate stiffness to synchronize the mean/low frequency movement between the platform and the tender under an environmental load produced during a 10-year winter storm, and enough slack during a 10-year storm to enable the tender to move to a tender standby position, and wherein the tender uses an at least 6-point mooring system for creating global equilibrium between the platform and the tender.

BRIEF SUMMARY OF THE INVENTION

The present invention is an implementation of a hawser system between a tension leg platform (TLP) and another vessel such as a tender-assisted drilling (TAD) vessel which may be a semi-submersible. Generally, a hawser is a large rope for towing, mooring, or securing a ship.

Drilling operations may be performed from the TLP while the nearby semi-submersible TAD vessel provides supporting services for the drilling operation, e.g. drilling fluid and drill pipe storage.

Certain embodiments of the invention employ two lines, oriented in a V-shape, to restrict the vertical motion of a hawser near the bow of the semi-submersible tender assisted drilling vessel (TAD). In certain embodiments, these lines comprise chain. Limiting the vertical motion of the hawsers significantly reduces the possibility of the hawsers contacting each other. A hawser system according to the invention couples the semi-submersible TAD vessel to the TLP.

A hawser system according to the invention may be implemented without the use of sheaves for the hawsers.

BRIEF DESCRIPTION OF THE SEVERAL VIEWS OF THE DRAWING(S)

DETAILED DESCRIPTION OF THE INVENTION

The invention may be an implementation of a hawser system between a tension leg platform (TLP) and a semi-submersible TAD vessel. Drilling operations may be performed from the TLP while the semi-submersible TAD vessel provides the supporting services for the drilling operation, e.g. drilling fluid and drill pipe storage; drilling fluid processing, and the like.

Certain embodiments of the invention use two lines, oriented in a V-shape, to restrict the vertical motion of a hawser near the bow of the TAD vessel. Limiting the vertical motion of the hawsers significantly reduces the possibility of the hawsers contacting one another.

The hawser system couples the semi-submersible TAD vessel to the TLP. The design requirements of such a system are not always easily implemented. For example, a complicated combination of hawser design requirements may be: 1) a relatively low pretension in the hawser; 2) position requirements of the semi-submersible, particularly transverse to the TLP—semi-submersible axis; and, 3) the requirement for a back-up system. The requirement of a low pretension generally manifests itself in long hawser lengths, while the requirement for accommodation of transverse displacement of the semi-submersible may be best achieved through a "crossed" hawser configuration. An example of a hawser configuration without a back-up system is shown in FIG. 1. Generally speaking, all elements of such systems may lie in one plane.

The hawsers may be in close proximity to each other near the bow of the TAD vessel, particularly for crossed configurations or for configurations wherein a second (back-up) hawser system may be required. It is highly desirable to prevent the hawsers from coming in contact with one another. The horizontal line 40 as shown in FIG. 1 does not provide sufficient restraint on the vertical motion of the hawser near the bow of the TAD vessel. The vertical motion of the hawser near the bow of the TAD vessel can be restrained when implementing two lines in a V-shaped orientation, e.g. as shown in FIG. 4C. As shown in FIG. 3, the V-shaped support line configuration allows for a second hawser system to be installed in basically the same plane without causing any interference between the various elements of the hawser system.

Figures 1A, 1B, 1C, 1D, 1E:
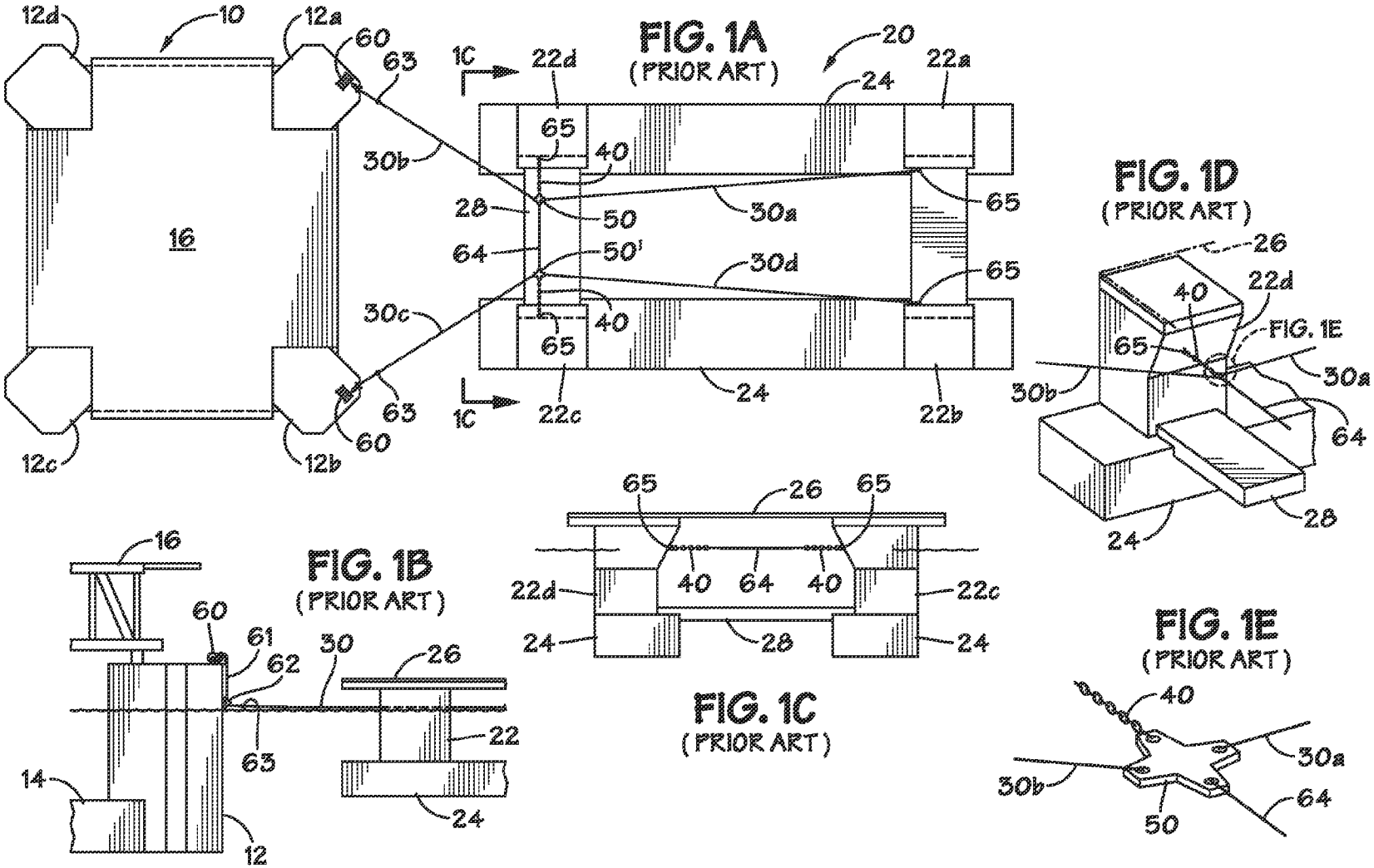
FIG. 1A (PRIOR ART)
FIG. 1B (PRIOR ART)
FIG. 1C (PRIOR ART)
FIG. 1D (PRIOR ART)
FIG. 1E (PRIOR ART)
FIG. 1A is a top plan view of a tension leg platform (TLP) connected to a semi-submersible tender-assisted drilling (TAD) vessel with a hawser system of the prior art.
FIG. 1B is a side view of the connected portions of the TLP and TAD vessel shown in FIG. 1A.
FIG. 1C is an end view of the TAD vessel taken along line 1C-1C in FIG. 1A.
FIG. 1D is a three-dimensional view of one corner of the TAD vessel shown in FIG. 1A.
FIG. 1E is an enlarged view of the portion indicated in FIG. 1D.

Some hawser systems of the prior art utilize a stretcher 64 as illustrated in FIGS. 1A, 1C and 1D. The stretcher 64 is an integral element of the hawser system as it connects the two legs (30*a*+30*b* and 30*c*+30*d*) of the hawser system. Both legs of the hawser system may be compromised when the stretcher fails; both hawsers are likely to hit the TAD columns 22*c* and/or 22*d* when the stretcher fails. The V-shaped line configuration of the present invention disconnects the two legs from each other, making the system more functionally robust than using a system with an interconnecting stretcher.

Embodiments of the invention may be free of sheaves to locate and orient the hawsers. Those skilled in the art will appreciate that sheaves can introduce significant wear on hawsers and thus the system of the present invention may lengthen the service life of the hawsers.

A hawser system of the prior art for interconnecting a TLP 10 and a semi-submersible TAD vessel 20 is shown in FIG. 1. TLP 10 comprises surface-piercing columns (12*a* through 12*d* in the illustrated system) which support deck 16. Underwater pontoons 14 connect adjacent columns. The TLP may have one or more columns. The planform of the columns may form any kind of shape, including a rectangle, as shown in the drawing figures, but it may also be a square, a triangle, a pentagon, etc. The TLP columns themselves may have any kind of shape, including, round, predominantly square, predominantly rectangular, or multifaceted. TAD vessel 20 in FIG. 1 is a four-column (22*a* through 22*d*) semi-submersible having a bow (proximate TLP 10) and a stern (distal from TLP 10). An opposing pair of underwater pontoons 24 connect between adjacent columns on the same side of the vessel. An opposed pair of inter-columns connectors 28 span between opposing columns 22 and/or pontoons 24 on opposite sides of vessel 20. A deck 26 is supported on the upper surfaces of columns 22. For clarity, deck 26 is shown removed in FIG. 1A.

The hawser connection system illustrated in FIG. 1 includes a pair of connectors 50 which, in this example, comprise quad plates. A support line 40 connects between each connector 50 and a nearby column proximate the bow of TAD vessel 20—i.e., column 22*d* or 22*c*. Padeyes 65 on the inboard surfaces of columns 22*d* and 22*c* are used to attach support lines 40. In the illustrated prior art hawser system, support lines 40 comprise chain. A stretcher 64 connects between the connectors 50 and 50'.

Hawser 30*a* is connected from a padeye 65 on column 22*a* to connector 50. Hawser 30D is connected from a padeye 65 on column 22*b* to connector 50'.

Hawser 30*b* connects from connector 50 to column 12*a* of TLP 10. Hawser 30*c* connects from connector 50' to column 12*b* of TLP 10. In order to avoid passing either hawser 30*b* or 30*c* through a sheave, the TLP end of hawser 30*b* and/or 30*c* is connected to rope-to-wire connector 63 which is connected to winch line 61 which passes through turning block 62 on the face of TLP column 12*a* (and/or 12*b*). Winch line 61 is tensioned by winch 60 on the upper surface of column 12 (see FIG. 1B).

It will be appreciated by those skilled in the art that the hawser system of the prior art illustrated in FIG. 1 provides no redundancy. The parting of any line or the failure of any connector will result in instability of the mooring. In particular, the failure of stretcher line 64 would adversely affect the hawsers on both sides of the vessels. Without stretcher line 64, support lines 40 are unable to restrain the vertical motion of the hawsers near the bow of TAD vessel 20.

It will be appreciated that the hawser system of the prior art such as that illustrated in FIG. 1 (as well as the various embodiments of the present invention) tend to bias the TLP and TAD vessel toward one another. Left unchecked, the TLP could be displaced from its desired position above the wellhead(s) on the seafloor and might even collide with the TAD vessel. To counter the bias applied by the hawser system, holdback lines may be provided on the TLP.

Figure 7A:
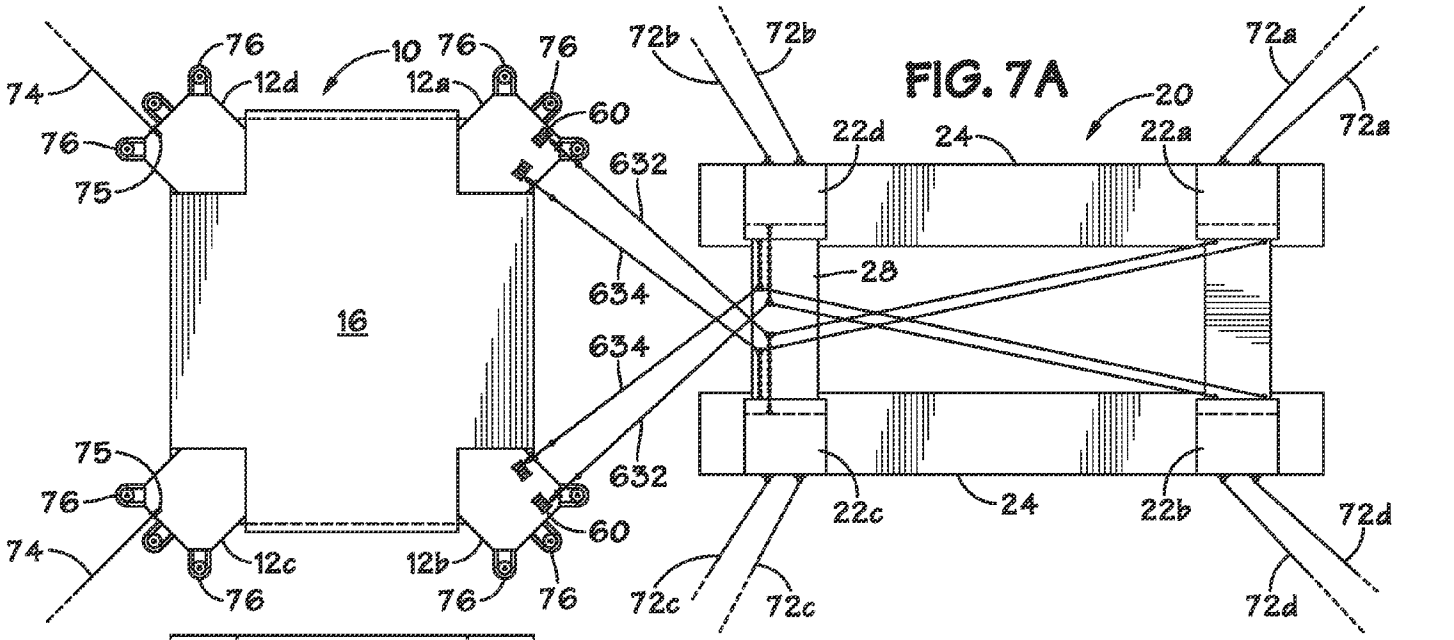
FIG. 7A is a top plan view of a tension leg platform (TLP) connected to a semi-submersible tender-assisted drilling (TAD) vessel with a hawser system according to the fifth embodiment showing the upper portions of the anchoring systems of both vessels.
Figure 7B:
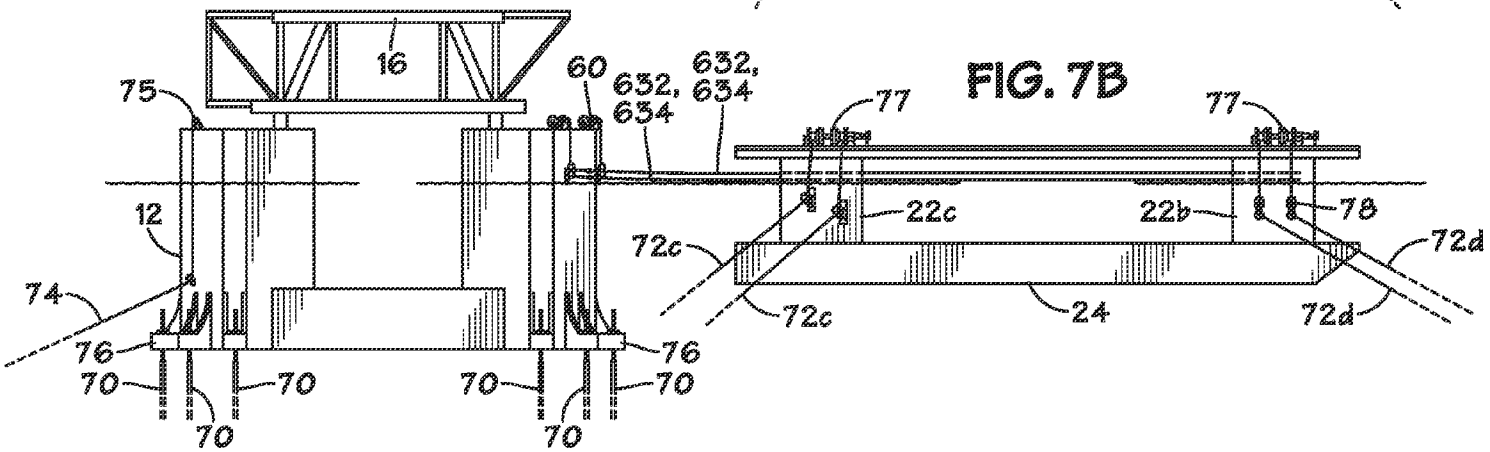
FIG. 7B is a side view of the tension leg platform (TLP) connected to a semi-submersible tender-assisted drilling (TAD) vessel with a hawser system according to the embodiment illustrated in FIG. 7A.

Referring now to FIGS. 7A and 7B, semi-submersible TAD vessel 20 is anchored conventionally with catenary anchor lines 72*a*, 72*b*, 72*c* and 72*d*. In the illustrated embodiment, the anchor lines pass through turning blocks 78 mounted on the outboard surface of the columns 22 and are routed to anchor winches 77 that may be used to individually tension the anchor lines 77. In this way, the nominal position of TAD vessel 20 may be adjusted. Particular care should be exercised in anchor positioning to ensure that anchor lines 72*b* and 72*c* do not interfere with the anchoring system of TLP 10.

TLP 10 is conventionally anchored to the seafloor with tendons 70 attached to tendon porches 76 on the outboard surfaces of columns 12.

Holdback lines 74 may be provided on TLP columns 12*c* and 12*d*. Holdback lines 74 may be anchor lines which connect on one end to one or more anchors set in the seafloor. By way of example, the anchors may be pile anchors, suction embedded anchors, plate anchors, or the like. Holdback lines 74 may pass through turning blocks or sheaves mounted on the TLP hull and to a holdback line winch 75 for tensioning the holdback line 74. Holdback lines 74 may be made of any suitable material, natural or synthetic. The holdback lines may comprise segments of various materials such as chain, wire, synthetic fiber and the like.

In this way, the bias applied by the hawser system is resisted by holdback lines 74 on TLP 10 and by anchor lines 72*a* and 72*d*, in particular, on TAD vessel 20.

The invention may best be understood by reference to the exemplary embodiment(s) illustrated in the drawing figures. FIGS. 2 through 6, inclusive, show various embodiments of the invention as applied to the TLP—TAD system shown in FIG. 1. For the sake of clarity, the elements of FIG. 1 that are repeated in FIGS. 2-6 have their reference numbers omitted in those drawings.

Figures 2A, 2B, 2C, 2D, 2E:
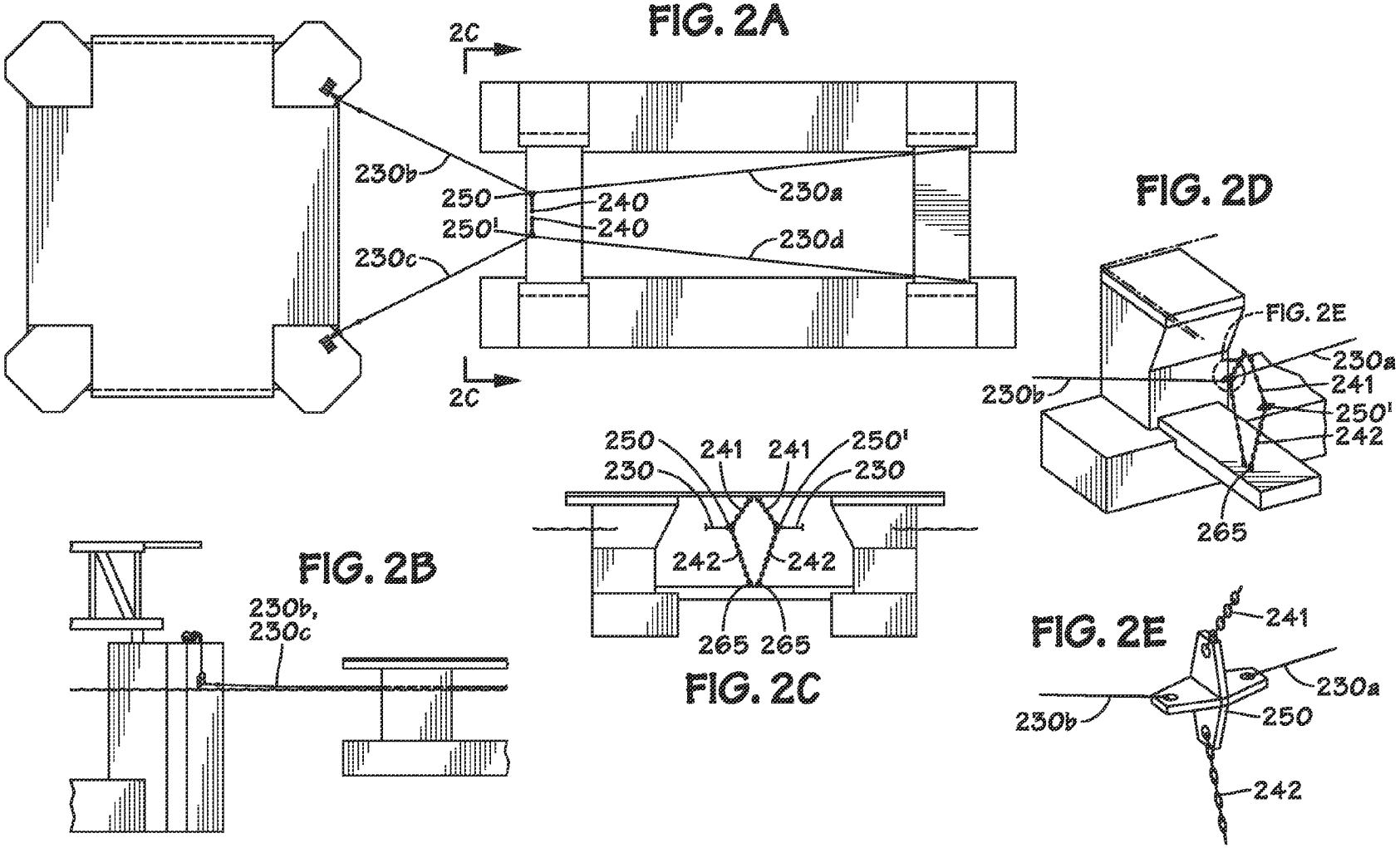
FIG. 2A is a top plan view of a tension leg platform (TLP) connected to a semi-submersible tender-assisted drilling (TAD) vessel with a hawser system according to a first embodiment.
FIG. 2B is a side view of the connected portions of the TLP and TAD vessel shown in FIG. 2A.
FIG. 2C is an end view of the TAD vessel taken along line 2C-2C in FIG. 2A.
FIG. 2D is a three-dimensional view of one corner of the TAD vessel shown in FIG. 2A.
FIG. 2E is an enlarged view of the portion indicated in FIG. 2D.

A hawser system according to a first embodiment of the invention is shown in FIG. 2. Connectors 250 and 250' are each supported by an upper connector line 241 attached to deck 26 (or its support structure) proximate the midline of the vessel 20 and a lower connector line 242 attached to a padeye 265 on transverse connector 28 proximate the midline of vessel 20.

Hawser 230*a* connects at a first end thereof to connector 250 and to a location on the inboard surface of the hull of vessel 20 closer to its stern than to its bow at a second end thereof. Hawser 230*d* connects at a first end thereof to connector 250' and to an opposing location on the inboard surface of the hull of vessel 20 closer to its stern than to its bow at a second end thereof.

Hawser 230*b* is connected at a first end thereof to connector 250 and at an opposing second end to a column of TLP 10 that is generally aligned with the side of the semi-submersible TAD vessel to which the second end of hawser 230*a* is attached. In a mirror image arrangement, hawser 230*d* is connected at a first end thereof to connector 250' and at an opposing second end to a column of TLP 10 that is generally aligned with the side of the semi-submersible TAD vessel to which the second end of hawser 230*d* is attached. As discussed above, one or more winch lines on the TLP may be provided for connecting hawsers 230*b* and 230*c*.

In the illustrated embodiment, connector 250 is a quad plate.

A hawser system according to a second embodiment of the invention is shown in FIG. 3. This embodiment provides a duplicate of each of the hawsers in the first embodiment (as shown in FIG. 2). Outer connector 350 is supported by upper connector line 341*a* attached to deck 26 (or its support structure) proximate the midline of the vessel 20 and a lower connector line 342*a* attached to a padeye 365 on transverse connector 28 proximate the midline of vessel 20. Inner connector 350 is likewise supported by upper connector line 341*b* attached to deck 26 (or its support structure) proximate the midline of the vessel 20 and a lower connector line 342*b* attached to a padeye 365 on transverse connector 28 proximate the midline of vessel 20.

Hawser 332*a* connects at a first end thereof to outer connector 350 and to a location on the inboard surface of the hull of vessel 20 closer to its stern than to its bow at a second end thereof. Hawser 334*a* connects at a first end thereof to inner connector 350 and to a location on the inboard surface of the hull of vessel 20 closer to its stern than to its bow at a second end thereof.

Hawser 332*b* is connected at a first end thereof to outer connector 350 and at an opposing second end to a column of TLP 10 that is generally aligned with the side of the semi-submersible TAD vessel to which the second end of hawser 332*a* is attached. Hawser 334*b* is connected at a first end thereof to inner connector 350 and at an opposing second end to a column of TLP 10 that is generally aligned with the side of the semi-submersible TAD vessel to which the second end of hawser 334*a* is attached. As discussed above, one or more winch lines on the TLP may be provided for connecting hawsers 332*b* and 334*b*.

Figures 3A, 3B, 3C, 3D, 3E:
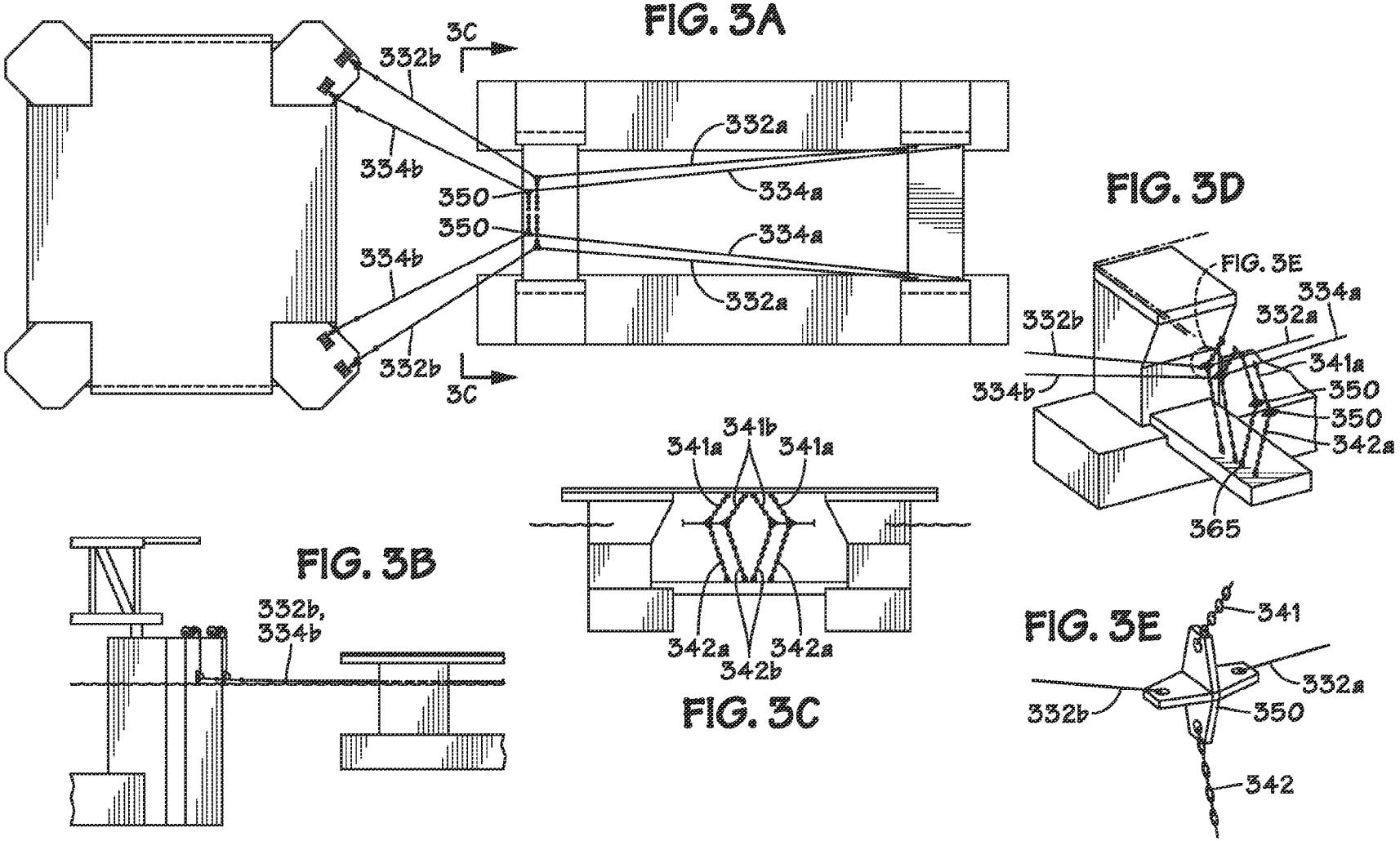
FIG. 3A is a top plan view of a tension leg platform (TLP) connected to a semi-submersible tender-assisted drilling (TAD) vessel with a hawser system according to a second embodiment.
FIG. 3B is a side view of the connected portions of the TLP and TAD vessel shown in FIG. 3A.
FIG. 3C is an end view of the TAD vessel taken along line 3C-3C in FIG. 3A.
FIG. 3D is a three-dimensional view of one corner of the TAD vessel shown in FIG. 3A.
FIG. 3E is an enlarged view of the portion indicated in FIG. 3D.
Figure 4A:
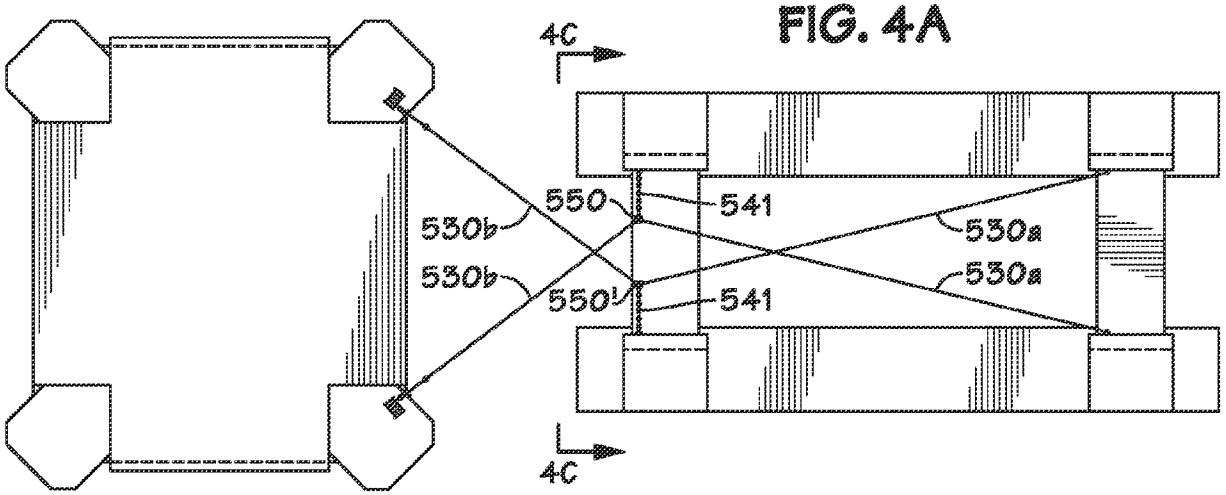
FIG. 4A is a top plan view of a tension leg platform (TLP) connected to a semi-submersible tender-assisted drilling (TAD) vessel with a hawser system according to a third embodiment.
Figure 4D:
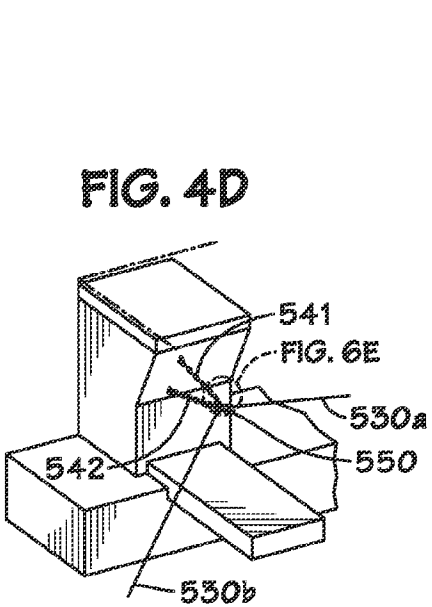
FIG. 4D is a three-dimensional view of one corner of the TAD vessel shown in FIG. 4A.
Figure 4C:
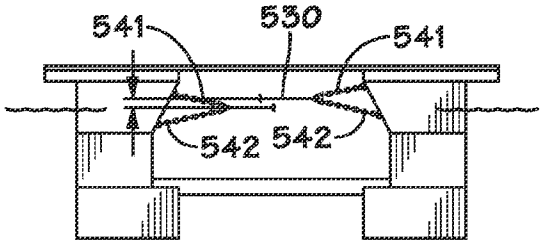
FIG. 4C is an end view of the TAD vessel taken along line 4C-4C in FIG. 4A.
Figure 4E:
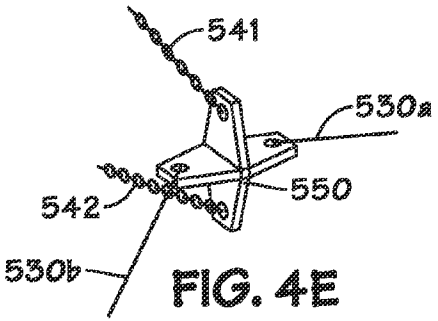
FIG. 4E is an enlarged view of the portion indicated in FIG. 4D.
Figure 4B:
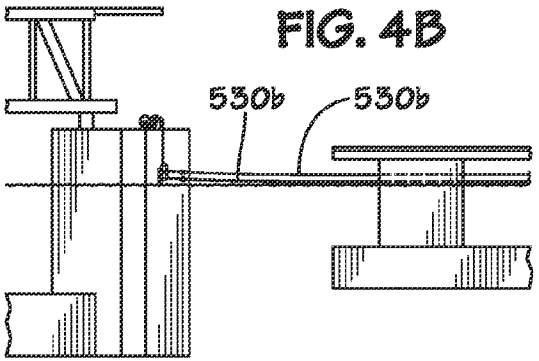
FIG. 4B is a side view of the connected portions of the TLP and TAD vessel shown in FIG. 4A.

As shown in FIG. 3A, the generally vertical plane of support lines 341*a* and 341*b* may be offset from the generally vertical plane of support lines 342*a* and 342*b*. In other embodiments, support lines 341*a*, 341*b*, 342*a* and 342*b* may all lie in substantially the same plane.

In the illustrated embodiment, connector 350 is a quad plate.

In a mirror image arrangement, these elements are repeated on the opposite side of each vessel.

A hawser system according to a third embodiment of the invention is shown in FIG. 4. Connector 550 is supported by an upper connector line 541 attached at a first, higher location on the inboard surface of column 22*d* and a lower connector line 542 attached to a second, lower location on the inboard surface of column 22*d*. Connector 550' is supported by an upper connector line 541 attached at a first, higher location on the inboard surface of column 22*c* and a lower connector line 542 attached to a second, lower location on the inboard surface of column 22*c*. As shown by the gap with opposing arrows in FIG. 4C, connector 550 is vertically displaced from connector 550'.

Hawser 530*a* connects at a first end thereof to connector 550 and to a location on the opposite inboard surface of the hull of vessel 20 closer to its stern than to its bow at a second end thereof.

Hawser 530*b* is connected at a first end thereof to connector 550 and at an opposing second end to a column of TLP 10 that is generally aligned with the side of the semi-submersible TAD vessel to which the second end of hawser 530*a* is attached. As discussed above, one or more winch lines on the TLP may be provided for connecting hawser 530*b*.

In the illustrated embodiment, connector 550 is a quad plate.

As illustrated, each of the elements of this embodiment discussed above is repeated in a mirror image arrangement on the opposing side of each vessel. Although hawsers 530*a* cross over each other (as do hawsers 530*b*), the vertical offset of connector 550 from connector 550' prevents the hawsers from contacting one another during normal operations.

A fourth embodiment of the invention is shown in FIG. 5. This embodiment essentially provides a duplicate of each element of the embodiment shown in FIG. 4 with an inner connector 650 attached to upper support line 641*a* and to lower support line 642*a* and an outer connector 650 attached to upper support line 641*b* and to lower support line 642*b*. Other elements are likewise numbered to correspond to the elements in FIG. 4.

Figures 5A, 5B, 5C, 5D, 5E:
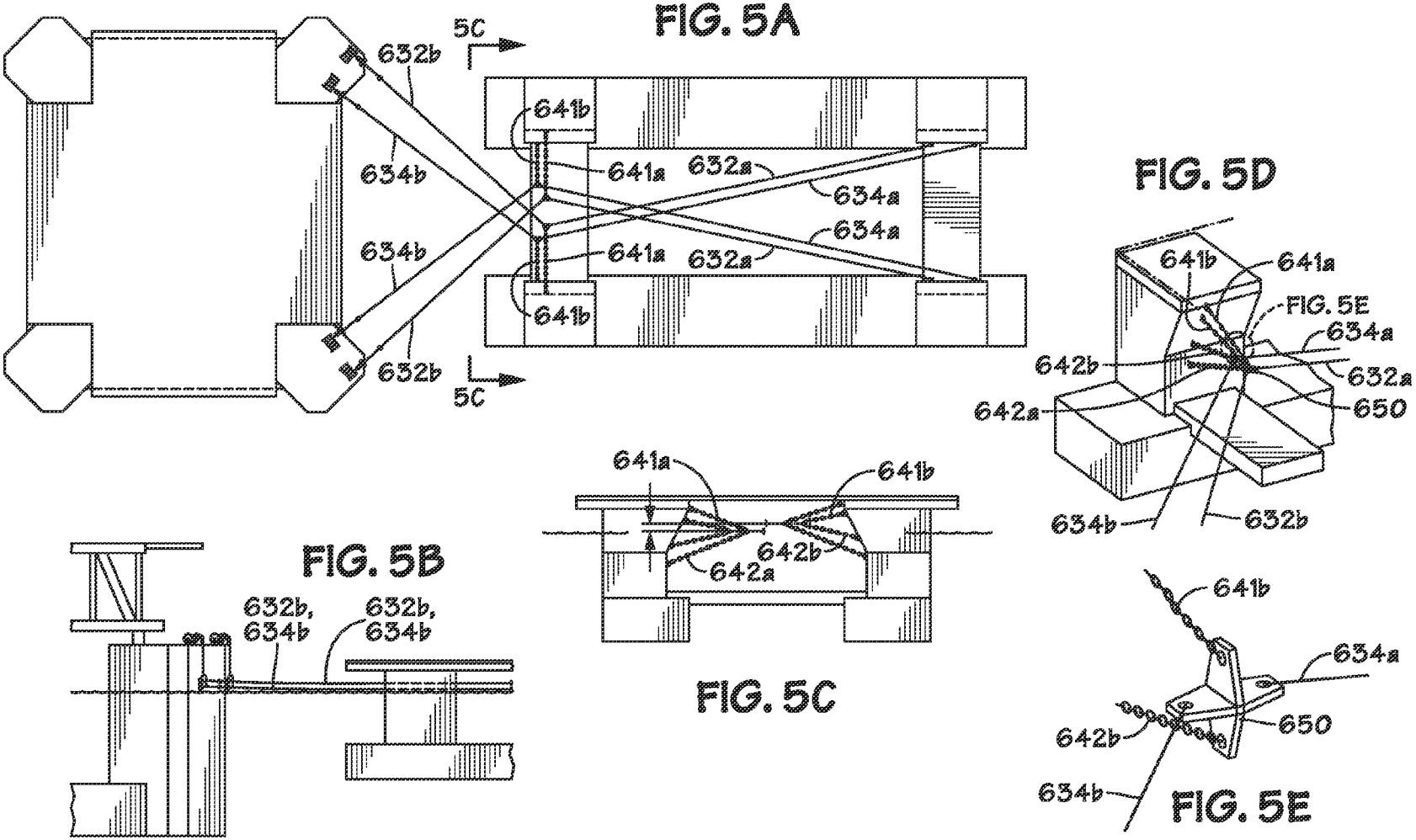
FIG. 5A is a top plan view of a tension leg platform (TLP) connected to a semi-submersible tender-assisted drilling (TAD) vessel with a hawser system according to a fourth embodiment.
FIG. 5B is a side view of the connected portions of the TLP and TAD vessel shown in FIG. 5A.
FIG. 5C is an end view of the TAD vessel taken along line 5C-5C in FIG. 5A.
FIG. 5D is a three-dimensional view of one corner of the TAD vessel shown in FIG. 5A.
FIG. 5E is an enlarged view of the portion indicated in FIG. 5D.

As shown in FIG. 5A, the substantially vertical plane in which support lines 641*a* and 642*a* lie may be transversely displace from the substantially vertical plane in which support lines 641*b* and 642*b* lie when in use. Alternatively, support lines 641*a*, 641*b*, 642*a* and 642*b* may all lie in substantially the same plane.

A fifth embodiment of the invention is shown in FIG. 6. This embodiment is an alternative to that illustrated in FIG. 5 and also essentially provides a duplicate of the elements of the embodiment shown in FIG. 4.

Inner connector 450 is attached to upper support line 441 and to lower support line 442. However, in this embodiment, outer connector 455 is attached to single support line 440. Inner connector 450 may be a quad plate. Outer connector 455 may be a tri plate. Other elements are likewise numbered to correspond to the elements in FIG. 4.

Figure 6A:
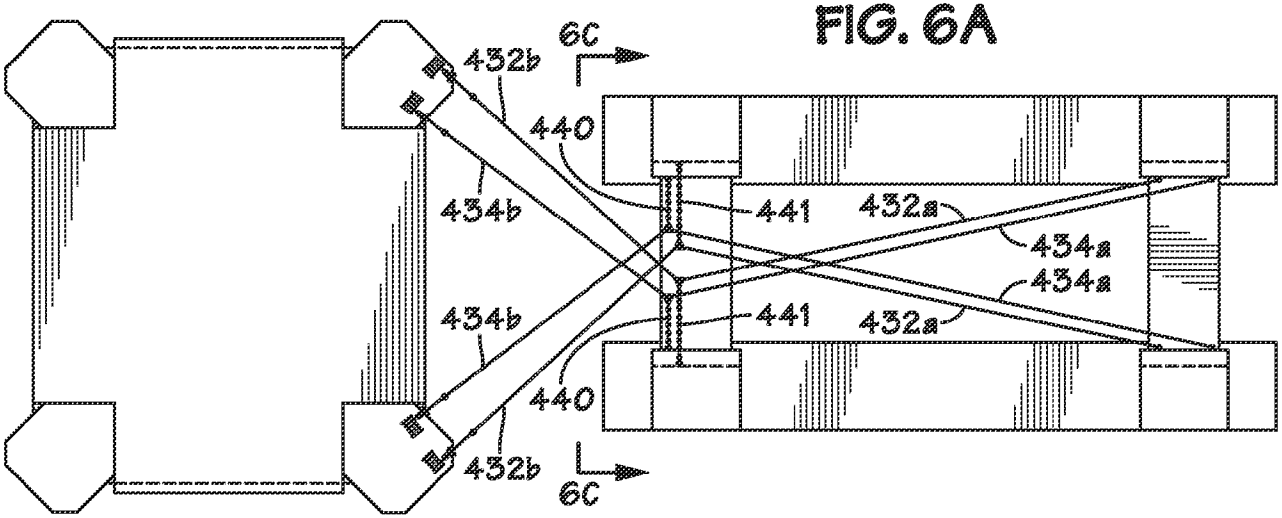
FIG. 6A is a top plan view of a tension leg platform (TLP) connected to a semi-submersible tender-assisted drilling (TAD) vessel with a hawser system according to a fifth embodiment.
Figure 6D:
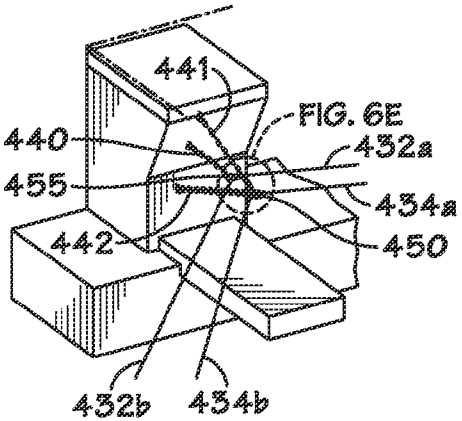
FIG. 6D is a three-dimensional view of one corner of the TAD vessel shown in FIG. 6A.
Figure 6E:
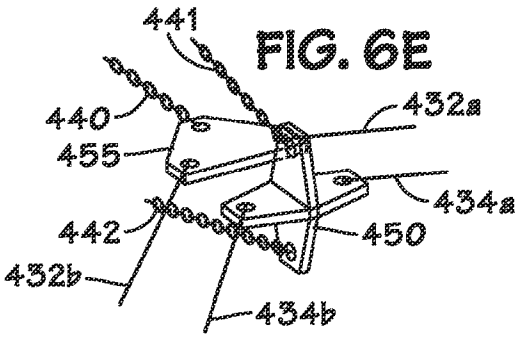
FIG. 6E is an enlarged view of the portion indicated in FIG. 6D.
Figure 6C:
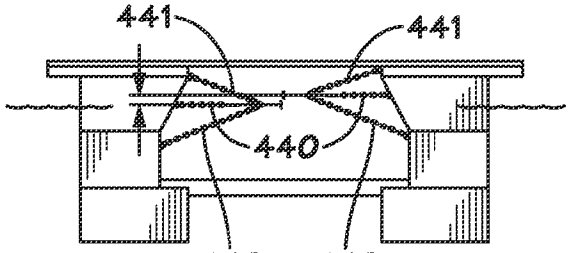
FIG. 6C is an end view of the TAD vessel taken along line 6C-6C in FIG. 6A.
Figure 6B:
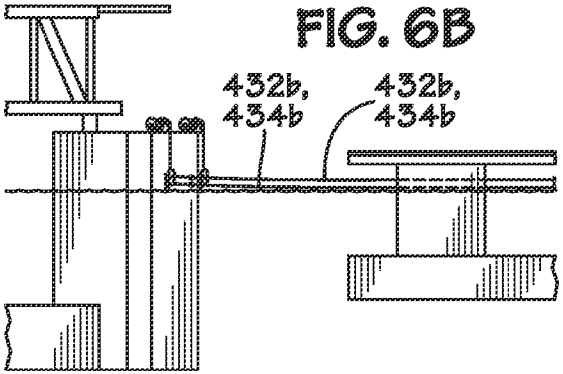
FIG. 6B is a side view of the connected portions of the TLP and TAD vessel shown in FIG. 6A.

As shown in FIG. 6A, support line 440 may be transversely displaced from the substantially vertical plane in which support lines 441 and 442 lie. Alternatively, support lines 440, 441, and 442 may all lie in substantially the same plane.

The hawsers in any of the above-described embodiments may be made of any suitable material, natural or synthetic. One particular preferred material for the hawsers is nylon which is commercially available as fiber, filament, yarn and other forms. Nylon may be a polyamide polymer but not all nylons are polyamide resins (nor are all polyamide resins nylons). Nylon hawsers generally have high tensile strength (high tenacity), low water absorption, high elasticity (with a rather high percentage of delayed recovery at low strain values), low permanent elongation and a wet strength approximately 90% of dry strength. Moreover, nylon is difficult to ignite and is self-extinguishing. The hawsers may comprise segments of various materials such as chain or wire.

The support lines attached to the connectors in any of the embodiments disclosed above may comprise any suitable tension element or combination thereof. Representative examples include rods, beams, bars, struts, flat plate(s), wire rope, nylon rope, polyester rope or chain. Chain is particularly preferred and, for convenience, is used herein to distinguish these lines attached to the connector from the hawsers attached to the connector.

It will be appreciated by those skilled in the art that, although the illustrated embodiments depict a TLP moored to a semi-submersible TAD vessel, other types of vessels may be used in the practice of the invention. By way of example only, a TLP may be moored to a catamaran using the method of the invention. A TLP may also be moored to a barge which may have one or more box-type structures, tubes or chutes enclosing the hawsers beneath an elevated deck. The hawser support lines (connector lines) of the invention (including those in a V configuration) may be attached to the sides of the box structure, or to one or more separate, purpose-built support structures.

It will also be appreciated by those skilled in the art that, although the illustrated embodiments depict the connectors and hawser support lines (upper and lower connector lines) attached to a semi-submersible TAD vessel moored to a TLP, the present invention may be practiced with the connectors and hawser support lines (upper and lower connector lines) attached to the TLP with hawsers such as 30*b* and 30*c* in FIG. 1A running from the connectors on the TLP to the auxiliary vessel—e.g., a semi-submersible TAD vessel.

Although particular embodiments of the present invention have been shown and described, they are not intended to limit what this patent covers. One skilled in the art will understand that that various changes and modifications may be made without departing from the scope of the present invention as literally and equivalently covered by the following claims.

What is claimed is:

1. A method of connecting a tension leg platform (TLP) to a tender-assisted drilling (TAD) vessel comprising:

a) attaching a first connector to a first end of a first support line;

b) attaching an opposing, second end of the first support line to the TAD vessel at a first, higher location proximate the midline of the TAD vessel;

c) attaching a first end of a second support line to the first connector;

d) attaching an opposing, second end of the second support line to the TAD vessel at a first, lower location proximate the midline of the TAD vessel;

e) attaching a first end of a first hawser to the first connector;

f) attaching a second, opposing end of the first hawser to the TAD vessel at a first hawser connection location;

g) attaching a first end of a second hawser to the first connector;

h) attaching an opposing, second end of the second hawser to the TLP at a second hawser TLP connection location;

i) attaching a second connector to a first end of a third support line;

j) attaching an opposing, second end of the third support line to the TAD vessel at a second, higher location proximate the midline of the TAD vessel;

k) attaching a first end of a fourth support line to the second connector;

l) attaching an opposing, second end of the fourth support line to the TAD vessel at a second, lower location proximate the midline of the TAD vessel;

m) attaching a first end of a third hawser to the second connector;

n) attaching a second, opposing end of the third hawser to the TAD vessel at a third hawser connection location;

o) attaching a first end of a fourth hawser to the second connector;

p) attaching an opposing, second end of the fourth hawser to the TLP at a fourth hawser TLP connection location.

2. A method as recited in claim 1 wherein the TAD vessel is a semi-submersible.

3. A method as recited in claim 2 wherein the semi-submersible is a four-column semi-submersible having a deck support structure, a pair of opposed pontoons connecting adjacent columns, a pontoon connector connected at a first end to a first pontoon and at an opposing second end thereof to a second pontoon and wherein the first, higher location proximate the midline of the TAD vessel is on deck support structure and the first, lower location proximate the midline of the TAD vessel is on the pontoon connector.

4. A method as recited in claim 1 wherein the first connector and second connector are quad plates.

5. A method as recited in claim 1 wherein the first, second, third and fourth support lines consist essentially of chain.

6. A method as recited in claim 1 wherein the first, second, third and fourth support lines comprise a material selected from the group consisting of: rods, beams, bars, struts, flat plate(s), wire rope, nylon rope, polyester rope and chain.

7. A method as recited in claim 1 wherein the first hawser connection location is on a first side of the TAD vessel, the third hawser connection location is on an opposing second side of the TAD vessel, the second hawser TLP connection location is on a first side of the TLP that is generally aligned with the first side of the TAD vessel and the fourth hawser TLP connection location is on an opposing second side of the TLP that is generally aligned with the second side of the TAD vessel.

8. A method as recited in claim 1 wherein attaching an opposing, second end of the second hawser to the TLP at a second hawser TLP connection location comprises attaching a winch line from the TLP to the second end of the second hawser.

9. A method as recited in claim 1 further comprising duplicating each of steps a through p, inclusive, and wherein the duplicate first, higher attachment location of the first duplicate support line proximate the midline of the TAD vessel and the duplicate first, lower attachment location of the second duplicate support line are outboard of the first, higher attachment location of the first support line proximate the midline of the TAD vessel and the first, lower attachment location of the second support line.

10. A method as recited in claim 9 wherein the duplicate first and second support lines lie in substantially the same vertical plane as the first and second support lines.

11. A method as recited in claim 9 wherein the duplicate first and second support lines lie in a vertical plane offset from the plane of the first and second support lines.

* * * * *